US012521788B2

(12) United States Patent
Igarashi et al.

(10) Patent No.: US 12,521,788 B2
(45) Date of Patent: Jan. 13, 2026

(54) DRIP PREVENTION DEVICE FOR PRESSURIZED POURING FURNACE

(71) Applicants: TPR CO., LTD., Tokyo (JP); TPR INDUSTRY CO., LTD., Sagae (JP)

(72) Inventors: Atsushi Igarashi, Sagae (JP); Shin Moriyama, Sagae (JP); Mizuki Yamashita, Sagae (JP)

(73) Assignees: TPR CO., LTD., Tokyo (JP); TPR INDUSTRY CO., LTD., Sagae (JP)

( * ) Notice: Subject to any disclaimer, the term of this patent is extended or adjusted under 35 U.S.C. 154(b) by 382 days.

(21) Appl. No.: 18/548,324

(22) PCT Filed: Mar. 8, 2021

(86) PCT No.: PCT/JP2021/008924

§ 371 (c)(1),
(2) Date: Aug. 29, 2023

(87) PCT Pub. No.: WO2022/190159

PCT Pub. Date: Sep. 15, 2022

(65) Prior Publication Data

US 2024/0300009 A1 Sep. 12, 2024

(51) Int. Cl.
*B22D 11/18* (2006.01)
*B22D 41/20* (2006.01)

(52) U.S. Cl.
CPC ..... *B22D 11/18* (2013.01); *B22D 41/20* (2013.01)

(58) Field of Classification Search
None
See application file for complete search history.

(56) References Cited

U.S. PATENT DOCUMENTS

2017/0261265 A1 9/2017 Fujito et al.

FOREIGN PATENT DOCUMENTS

JP H06-091360 A 4/1994
JP H0691360 A * 4/1994
JP H08-164471 A 6/1996
(Continued)

OTHER PUBLICATIONS

Patent Cooperation Treaty, International Search Report, Application No. PCT/JP2021/008924, dated May 25, 2021, in 4 pages.

*Primary Examiner* — Anthony M Liang
(74) *Attorney, Agent, or Firm* — PROCOPIO, CORY, HARGREAVES & SAVITCH LLP

(57) ABSTRACT

A drip prevention device for a pressurized pouring furnace according to the present disclosure is a device 10 that prevents dripping of molten metal from a molten metal outlet of the pressurized pouring furnace The drip prevention device 10 includes: a stopper 20 that brings a lower end thereof into contact with the outlet so as to block the outlet, and is provided so as to be able to rotate about a central axis 20C of the stopper with no rotation angle limitation and move vertically above the outlet; a rotation motor 30 that rotates the stopper 20; a drip detection device 60 that detects dripping of molten metal from the outlet in a case where the dripping occurs; and a control device 70 that, in a case where a drip detection signal is received from the drip detection device 60, drives the rotation motor 30 to cause the stopper 20 to perform a predetermined rotation operation.

8 Claims, 7 Drawing Sheets

(56) References Cited

FOREIGN PATENT DOCUMENTS

| | | | |
|---|---|---|---|
| JP | H09-174229 | A | 7/1997 |
| JP | 2014-172044 | A | 9/2014 |
| JP | 2017-159334 | A | 9/2017 |
| JP | 2019-166554 | A | 10/2019 |

* cited by examiner

T1: FORWARD ROTATION UNTIL DRIPPING STOPS

T2: REVERSE ROTATION UNTIL DRIPPING STOPS

T3: FORWARD AND REVERSE ROTATION UNTIL DRIPPING STOPS WITHIN TIME PERIOD SET IN CONTROL PANEL

T4: FORWARD ROTATION FOR TIME PERIOD SET IN CONTROL PANEL

T5: REVERSE ROTATION FOR TIME PERIOD SET IN CONTROL PANEL

DRIP PREVENTION DEVICE FOR PRESSURIZED POURING FURNACE

CROSS-REFERENCE TO RELATED APPLICATIONS

This application is US National Stage of International Patent Application PCT/JP2021/008924, filed Mar. 8, 2021, the contents of which are incorporated herein by reference.

TECHNICAL FIELD

The present invention relates to a drip prevention device for a pressurized pouring furnace.

BACKGROUND ART

A pressurized pouring furnace is a furnace used, for example, to automatically pour molten metal into a line for molding, and has a structure in which, for example, a pouring nozzle provided at the outlet is opened or closed with a stopper pin to release or stop the flow of molten metal.

When continuously casting using such a pressurized pouring furnace, over time, inclusion such as oxide of alloy components contained in molten metal, refractory materials constituting the furnace, or foreign matter mixed in material may become trapped between the pouring nozzle and the stopper pin of the pressurized pouring furnace, causing molten metal to leak through the gap (so-called "dripping"). Conventional methods for detecting and dealing with such dripping that may occur in this manner have been proposed (see, for example, Patent Documents 1 to 3), and in practice, an operator or the like (collectively referred to herein as the "operator") inserts an operating steel rod (guide pin) 525 into a guide pipe 522 on the side of the stopper pin 520A, and manually operates the steel rod to turn the stopper pin around (see FIG. 7). In such a case, as the stopper pin 520A is turned, any foreign matter trapped between the stopper pin 520A and the pouring nozzle 510 is worn away, eliminating the gap and stopping the dripping.

CITATION LIST

Patent Document

Patent Document 1: Patent Publication JP 2014-172044A
Patent Document 2: Patent Publication JP 2019-166554A
Patent Document 3: Patent Publication JP 2017-159334A

SUMMARY

Technical Problem

However, as described above, it is extremely complicated for the operator to repeat the operation of inserting the iron rod and manually turning the stopper pin each time the operator notices dripping, and it is also inefficient and unreliable for the operator to perform various other tasks while monitoring the presence/absence of dripping. In addition, it is not always safe to manually turn the stopper pin in a pressurized pouring furnace where the temperature is high.

In addition, when the operator grabs the iron bar and manually turns the stopper pin, the iron bar may hit a part of the molten metal pouring equipment while being turned, or even if it does not hit a part of the equipment, the operator actually halts and moves the iron bar to the left or right so as to turn the stopper pin only within a certain angle, rather than moving around the stopper pin while grabbing the iron bar. In reality, the operator does not actually rotate the stopper pin 360° or more.

An object of the present invention is to provide a drip prevention device for a pressurized pouring furnace that eliminates the need for a person to monitor dripping of molten metal in a pressurized pouring furnace and allows for safe and reliable labor-saving.

Solution to Problem

One aspect of the present invention is a drip prevention device for a pressurized pouring furnace, the drip prevention device preventing dripping of molten metal from a molten metal outlet of a pressurized pouring furnace, and including:

- a stopper that brings a lower end thereof into contact with the outlet so as to block the outlet, and is provided so as to be able to rotate about a central axis of the stopper with no rotation angle limitation and move vertically above the outlet;
- a rotation motor that rotates the stopper;
- a drip detection device that detects dripping of molten metal from the outlet in a case where the dripping occurs; and
- a control device that, in a case where a drip detection signal is received from the drip detection device, drives the rotation motor to cause the stopper to perform a predetermined rotation operation.

The drip prevention device of this aspect does not require a person to monitor the detection of dripping. In addition, when dripping is detected, the control device drives the rotation motor and causes the stopper to perform a predetermined rotation operation, to perform, in a way, an automatic/autonomous drip prevention operation, allowing for reliable labor-saving. Moreover, the operator does not need to manually rotate the stopper in the pressurized pouring furnace where the temperature is high, so the operation is done more safely.

In the drip prevention device of the foregoing aspect, the stopper may be supported by a support device so as to be able to rotate and move vertically.

The stopper of the drip prevention device described above may further include a spline shaft portion slidable with respect to the support device.

The drip prevention device described above may further include a transmission member that transmits a rotational force of the rotation motor to the stopper.

The transmission member described above may be a metallic drive chain.

An imaging device that captures an image near the outlet may be used as the drip detection device of the drip prevention device described above.

The drip prevention device described above may be configured to evacuate the entire pressurized pouring furnace if dripping is still detected in an amount exceeding a threshold value after the stopper is rotated for a predetermined period of time.

The drip prevention device described above may be equipped with a lifting device that moves the stopper vertically.

Advantageous Effects of Invention

According to the present invention, the need for a person to monitor dripping in a pressurized pouring furnace can be eliminated, thereby allowing for safe and reliable labor-saving.

DESCRIPTION OF EMBODIMENTS

Figure 1:
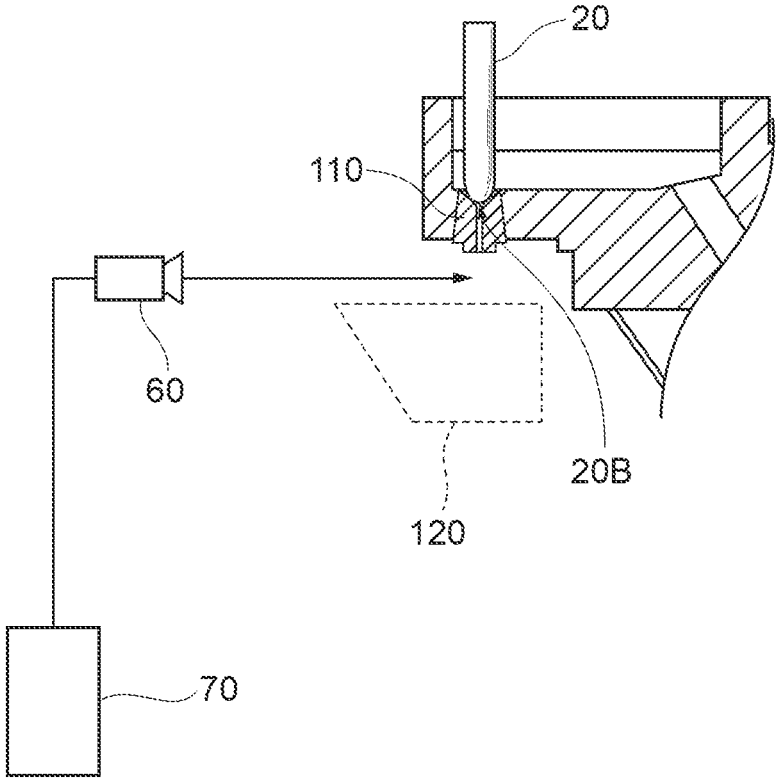
FIG. 1 is a schematic diagram of a stopper pin blocking a molten metal outlet of a pressurized pouring furnace in one embodiment of the present invention.

The following is a detailed description of the configuration of the present invention based on an example of an embodiment shown in the drawings (see FIGS. 1 to 6).

A pressurized pouring furnace (in the diagram, the body side of the pressurized pouring furnace is omitted and only the area near the molten metal outlet of the furnace is shown) is a furnace used for automatically pouring molten metal into a molding or other line, for example. In the present embodiment, a pouring nozzle 110, which serves as the molten metal outlet, is structured to open and close with a stopper 20 to let out and stop molten metal. When the stopper is raised, a gap is formed between a lower end 20B of a stopper pin 20A, which constitutes the stopper 20, and the pouring nozzle 110, and molten metal pours out therefrom. When the stopper 20 is lowered so that the lower end 20B comes into contact with the pouring nozzle 110 and the gap disappears, the molten metal stops pouring (see FIG. 1). The molten metal from the pouring nozzle 110 is stored, for example, in a pot 120 located below the pouring nozzle 110. If this pot 120 is weighed and controlled so that the stopper 20 is lowered when a stored weight reaches a set value, a predetermined amount of molten metal can be automatically poured.

In lowering the stopper 20 as described above, if foreign matter (such as slag) is caught between the lower end 20B of the stopper pin 20A and the pouring nozzle 110, the lower end 20B and the pouring nozzle 110 cannot adhere closely, causing leakage of the molten metal from the gap. The drip prevention device 10 for a pressurized pouring furnace according to the present invention is a device for preventing dripping of molten metal from the pouring nozzle 110, and the drip prevention device 10 of the present embodiment includes, for example, the stopper 20, a rotation motor 30, a drive chain 40, a rotating vertical mechanism 50, an imaging device 60, a control device 70, and the like (see FIGS. 2, 3, etc.).

The stopper 20 is a member that brings the lower end 20B of the stopper pin 20A into contact with the pouring nozzle 110 of the pressurized pouring furnace to block the pouring nozzle 110. The specific shape of the stopper 20 is not particularly limited. For example, in the present embodiment, a long member having a hexagonal shaft portion 20R partially having a hexagonal cross-sectional shape and a spline shaft portion (not shown) is connected to the upper portion of the stopper pin 20A, and the resultant member is used as the stopper 20 (see FIGS. 2, 3, etc.). The stopper 20 is positioned above the pouring nozzle 110 of the pressurized pouring furnace so that its central axis 20C is vertical, and is supported by the rotating vertical mechanism 50 provided on, for example, a support stand 80 so as to be, in this position, vertically movable and rotatable about the central axis 20C without limitation of rotation angle (see FIGS. 2 and 3). The foregoing arrangement example of the stopper 20 is merely a favorable example and is not limited to such a position. The stopper 20 may also be provided with a guide pipe 22 for inserting an iron rod (guide pin) to be used by the operator for manual operation (see FIGS. 2 and 3).

The rotating vertical mechanism 50 is composed of, for example, a sprocket 52, a collar 53, and a bearing portion 55. The sprocket 52 rotates about the central axis 20C of the stopper 20 while transmitting a rotational force of the rotation motor 30 to the bearing portion 55. The bearing portion 55 is a bearing consisting of, for example, the collar 53, a collar 54, a bush 56, a collar 59, and the like, and mounted on the support stand 80, and holds the stopper 20 in a relative non-rotatable state by means of six holding bolts 53*p* and/or hexagonal support holes 58 that are in abutment with each face of the hexagonal shaft portion 20R of the stopper 20 (see FIGS. 4 and 5). The bearing portion 55 holds the stopper 20 in a slidable (i.e., vertically movable) state along a longitudinal direction (in the present embodiment, vertical direction) along the central axis 20C (see FIGS. 2, 3, etc.). The hexagonal shaft portion 20R is trapped in the hexagonal holes of the bearing portion 55 and transmits the rotation.

The rotation motor 30 is the power source for rotating the stopper 20 about its central axis 20C without limitation of rotation angle. The rotation motor 30 in the present embodiment is provided on the support stand 80 (see FIGS. 2 and 3), but this is an example; the rotation motor 30 may be provided at other locations. The rotation motor 30 may be provided near the stopper 20 to directly rotate the stopper 20 via gears, etc., or the rotation motor 30 may be provided at a distance from the stopper 20 as in the present embodiment, and the power may be transmitted via a transmission member to rotate the stopper 20 (see FIGS. 2 and 3). If the rotation motor 30 is provided at a distance from the stopper 20 as in the present embodiment, the distance from the pressurized pouring furnace to the rotation motor 30 can be kept long, so that the impact of heat generated by the pressurized pouring furnace on the rotation motor 30, etc. can be reduced. If the impact of heat is to be taken into consideration, it is favorable to use a metal member as the transmission member. The rotation motor 30 of the present embodiment is provided with a sprocket 32 for transmitting the rotational force to the transmission member (see FIG. 3, etc.).

The drive chain 40 functions as a member that transmits the rotational force of the rotation motor 30 to the stopper 20. Considering the impact of heat described above, the present embodiment employs the drive chain 40 made of metal. The drive chain 40 is wound around both the sprocket 32 on the rotation motor 30 side and the sprocket 52 on the stopper 20 side (see FIG. 3, etc.). When the sprocket 52 rotates, the stopper 20 rotates together by the same amount.

Figure 2:
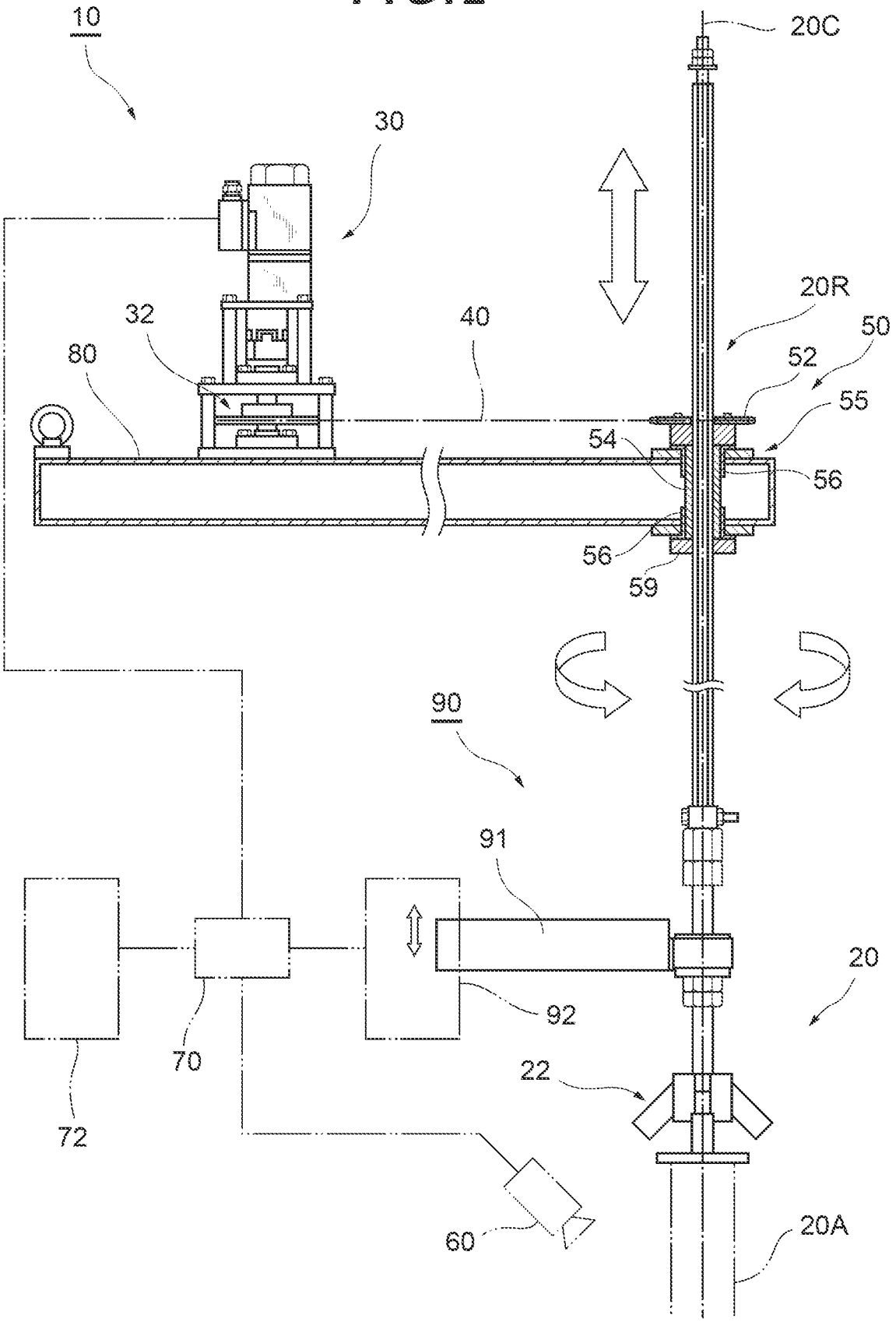
FIG. 2 is a diagram showing a partial cross section of a configuration example of a drip prevention device of the pressurized pouring furnace.
Figure 3:
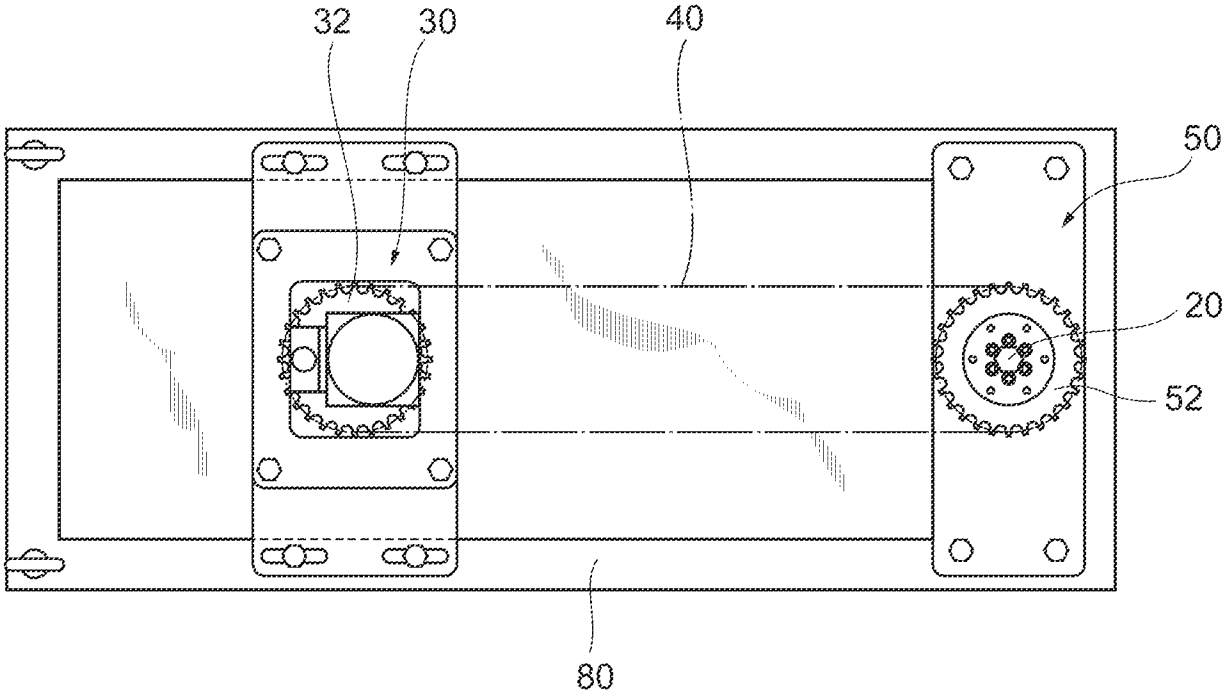
FIG. 3 is a plan view of the drip prevention device shown in FIG. 2.
Figure 4:
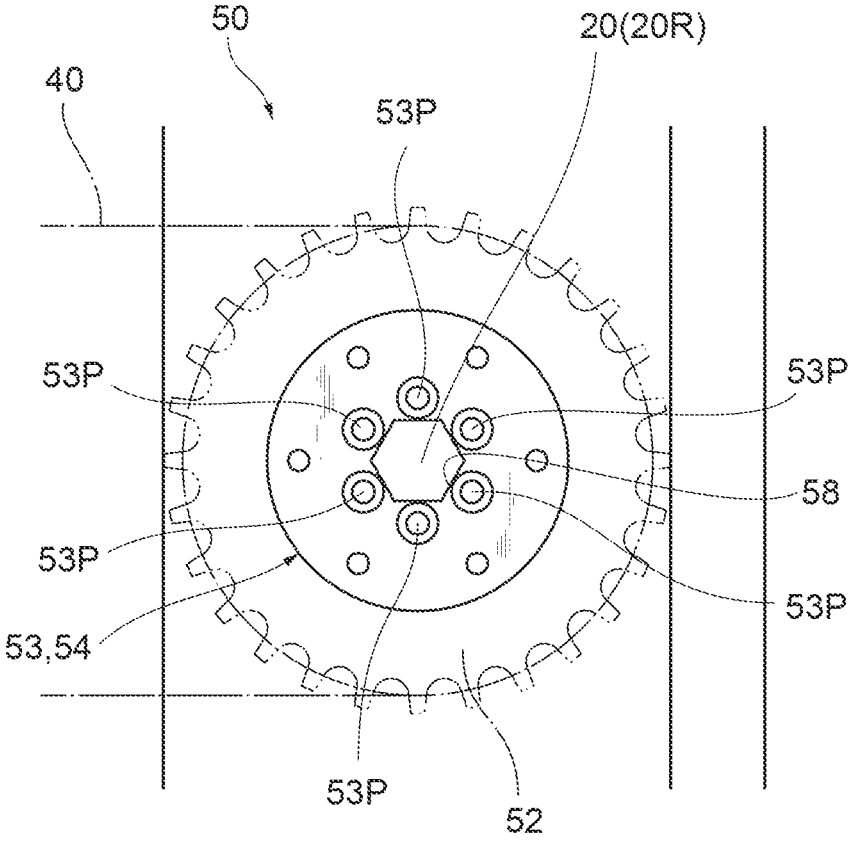
FIG. 4 is an enlarged view of the area around a rotating vertical mechanism of the drip prevention device shown in FIG. 3.
Figure 5:
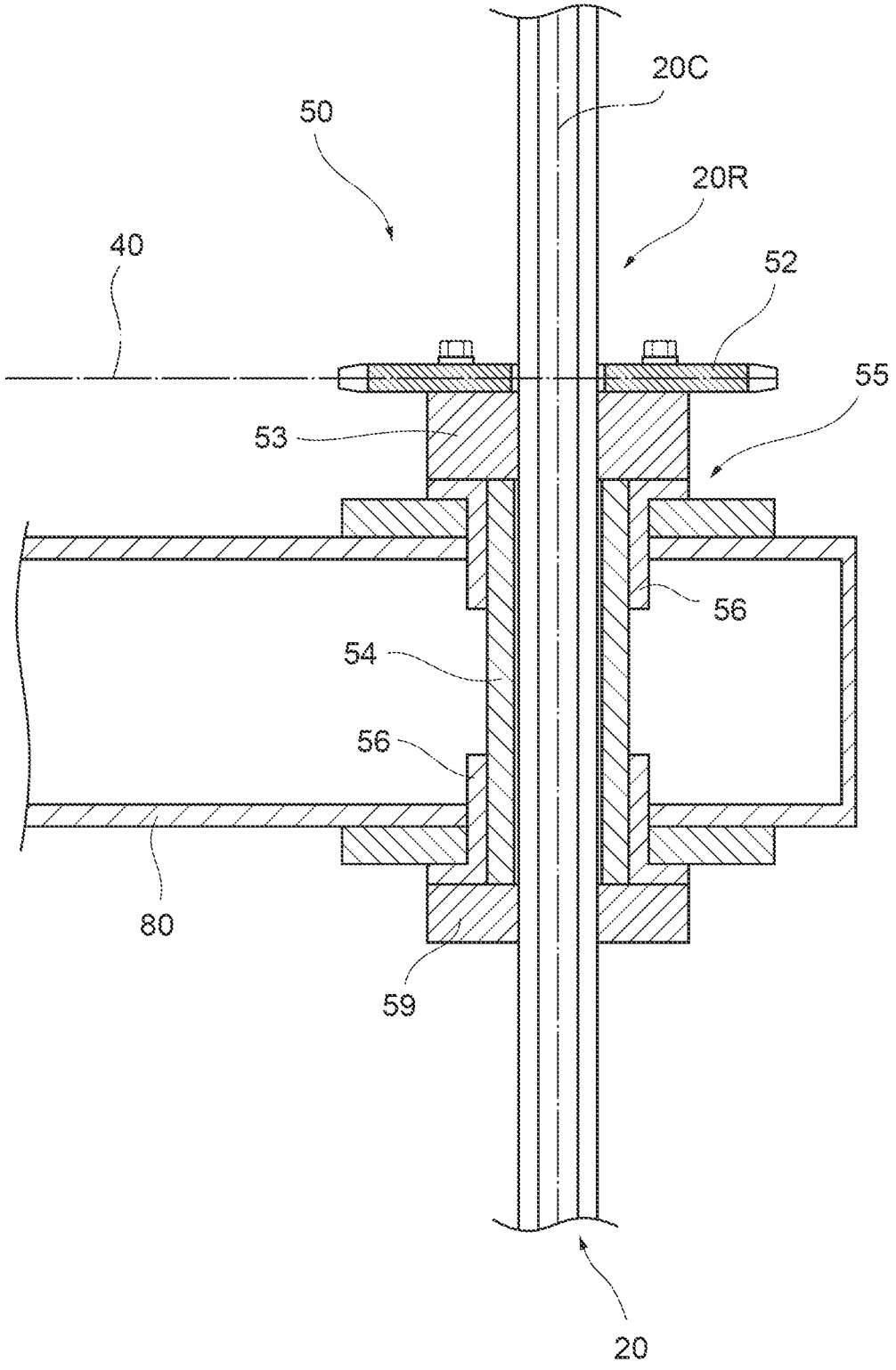
FIG. 5 is an enlarged view of the area around a rotating vertical mechanism of the drip prevention device shown in FIG. 2.

The imaging device 60 is a device that is installed to capture images near the pouring nozzle 110 of the pressurized pouring furnace, acquires images to determine whether or not there is any dripping from the pouring nozzle 110, and transmits signals of the images to the control device 70 (see FIGS. 1 and 2). The imaging device 60 itself can be any known device, as long as it is capable of acquiring data sufficient to determine whether or not there is any dripping. The imaging device 60 described in the present embodiment is merely one favorable example of a device that detects dripping in case of the dripping, and, needless to say, a device that detects other changes associated with dripping (for example, the weight of the molten metal stored in the pot, which is not described in detail herein) can be applied instead.

The control device 70 is a device that includes an arithmetic processing unit that processes information received from the outside and outputs control signals according to the results of the processing, and an information storage unit that stores necessary data. When the control device 70 of the present embodiment receives a drip detection signal from the imaging device 60 (or a configuration is possible in which image data is processed by the control device 70 and whether or not there is dripping is determined), the rotation motor 30 is rotated to cause the stopper 20 to perform a predetermined rotation operation (see FIG. 2, etc.).

A lifting device 90 is a device used to vertically move the stopper 20. In the present embodiment, a vertical movement shaft (lever) 91 is provided at a position above the stopper pin 20A and below the rotating vertical mechanism 50, and the stopper 20 can be moved vertically by raising and lowering the vertical movement shaft 91 (see FIG. 2). The raising and lowering of the vertical movement shaft 91 may be done manually by the operator, or may be done automatically by using a cylinder 92. The vertical movement shaft 91 may be made to be freely fitted against the stopper 20, and the stopper 20 may be pressurized in the axial direction and subjected to an extra force.

The drip prevention device 10 may be equipped with, for example, a control panel 72, which is a device for accepting inputs such as operation patterns and times for causing the stopper 20 to perform rotational movements (see FIG. 2). By using the control panel 72, the operator can input signals as needed each time he/she causes the stopper 20 to rotate.

Next, an operation pattern for driving the rotation motor 30 to cause the stopper 20 to perform a predetermined rotation operation will be explained with an example (see FIGS. 6A to 6E).

[Pattern 1]

Figure 6A:
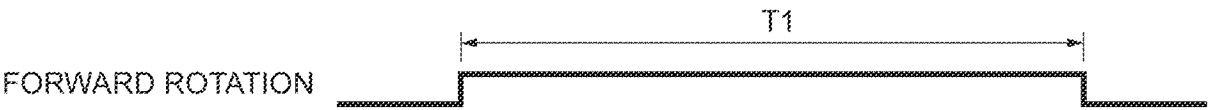
FIGS. 6A to 6E are examples showing an operation pattern obtained when the stopper is caused to perform a rotation operation.

The stopper 20 is caused to rotate forward (clockwise or counterclockwise in FIG. 4) at a constant speed for a time period T1 (see FIG. 6A). The time period T1 may be a time period set in a program and stored in the control device 70 according to a preset pattern, or may be the time it takes until the molten metal actually stops dripping. In this example, for example, the stopper 20 is rotated forward until the dripping stops. The control device 70 analyzes and determines imaging data obtained by the imaging device 60, to determine whether or not dripping has stopped. When it is determined that the dripping has stopped, the control device 70 stops the rotation motor 30 to stop the rotation of the stopper 20.

[Pattern 2]

Figure 6B:
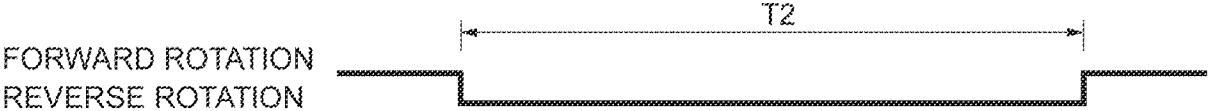

During a time period T2, the stopper 20 is reversed (rotated in the opposite direction from pattern 1) at a constant speed (see FIG. 6B). The time period T2 may be the time period set in the program and stored in the control device 70 according to a preset pattern, or may be the time it takes until the molten metal actually stops dripping. In this example, for example, the stopper 20 is reversed until the dripping stops. The control device 70 analyzes and determines imaging data obtained by the imaging device 60, to determine Whether or not dripping has stopped. When it is determined that the dripping has stopped, the control device 70 stops the rotation motor 30 to stop the rotation of the stopper 20.

[Pattern 3]

Figure 6C:
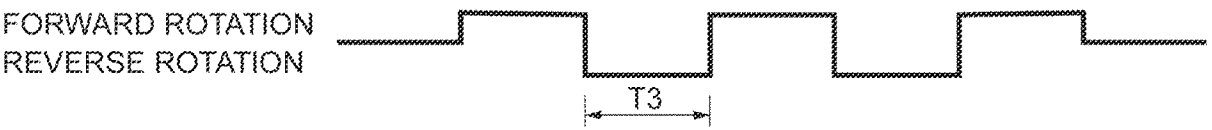

After the stopper 20 is rotated forward at a constant speed for a time period T3, the stopper 20 is rotated backward for the time period T3, and so on, alternating forward and reverse rotation, until the molten metal stops dripping (see FIG. 6C). The time period T3 may be set by the operator using, for example, the control panel 72.

[Pattern 4]

Figure 6D:
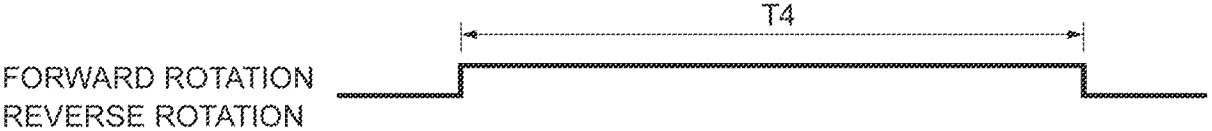

The stopper 20 is rotated forward at a constant speed for a time period T4 (see FIG. 6D). The time period T4 may be set by the operator using, for example, the control panel 72.

[Pattern 5]

Figure 6E:
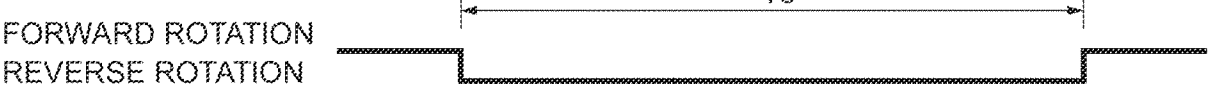
Figure 7:
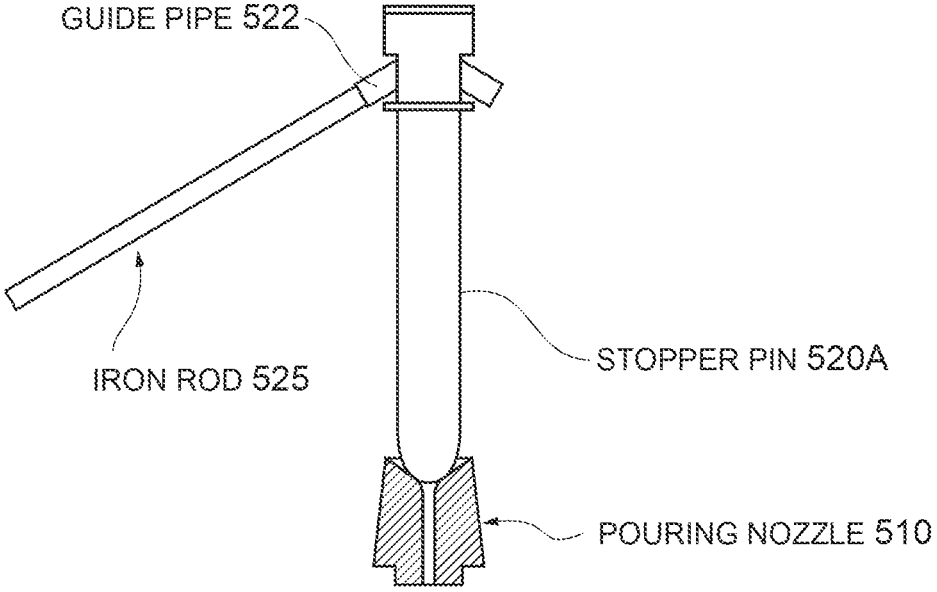
FIG. 7 is a reference diagram for explaining an example of a conventional countermeasure for preventing dripping.

The stopper 20 is reversed at a constant speed for a time period T5 (see FIG. 6E). The time period T5 may be set by the operator using, for example, the control panel 72.

[Pattern 6]

If, after rotating the stopper 20 for a predetermined period of time, the amount of dripping exceeding a threshold is still detected, the pressurized pouring furnace may be fully evacuated (not specifically shown in the diagram). In such a case, since the dripping may not be eliminated by causing the stopper 20 to keep rotating, once the furnace is fully evacuated, the pouring nozzle 110 and its surroundings may be inspected and cleaned if necessary, or other measures may be taken. In principle, the molten metal dripping from the pouring nozzle 110 should not be used.

Various operation patterns, including the above examples, may be stored in advance in the information storage unit of the control device 70 and may be selected by the operator according to the situation, or the operator may be able to set various parameters each time via input reception means such as the control panel 72 described above.

As explained so far, according to the present embodiment of the drip prevention device 10, a monitor is not necessary because the imaging device (drip detection device) 60 is configured to detect dripping. When dripping is detected, the control device 70 drives the rotation motor 30 to cause the stopper 20 to rotate automatically and autonomously without limitation of rotation angle, thereby ensuring reliable labor-saving. In addition, since the conventional operation in which the operator manually rotates the stopper 20 in a pressurized pouring furnace where the temperature is high is no longer necessary, a safer working environment can be provided for the operator.

Although the embodiment described above is an example of a favorable implementation of the present invention, the present invention is not limited thereto and can be modified and implemented in various ways without departing from the gist of the present invention. For example, the foregoing embodiment has only described the mode in which the stopper 20 is simply rotated, but when rotating the stopper 20 in this manner, the stopper 20 may be rotated, while an external force is applied along the central axis 20C by utilizing, for example, a biasing spring (not shown). If the stopper 20 is simply rotated, the force acting on the lower end 20B of the stopper pin 20A, the pouring nozzle 110, and foreign matter caught therebetween is basically the force of the dead weight of the stopper 20 or the like, but the stopper 20 can be rotated while applying a larger force by the foregoing configuration. In addition, the stopper 20 may be moved vertically as necessary to advance the pouring operation, and the like, in order to respond to various operational situations, such as advancing the pouring operation with priority given to casting even if there is dripping of molten metal.

INDUSTRIAL APPLICABILITY

The present invention is suitable for use in a device for preventing dripping of molten metal from the molten metal outlet of a pressurized pouring furnace.

REFERENCE SIGNS LIST

10 Drip prevention device
20 Stopper
20A Stopper pin
20B Lower end
20C Central axis
20R Hexagonal shaft portion
22 Guide pipe
30 Rotation motor
32 Sprocket
40 Drive chain (transmission device)
50 Rotating vertical mechanism
52 Sprocket
53 Collar
53*p* Bolt
54 Collar
55 Bearing portion
56 Bush
58 Support hole
59 Collar
60 Imaging device (drip detection device)
70 Control device
72 Control panel
80 Support stand (support device)
90 Lifting device
91 Vertical movement shaft
92 Cylinder
110 Pouring nozzle (molten metal outlet)
120 Pot
510 Pouring nozzle
520A Stopper pin
522 Guide pipe
525 Iron rod (guide pin)

What is claimed is:

1. A drip prevention device for a pressurized pouring furnace, the drip prevention device preventing dripping of molten metal from a molten metal outlet of the pressurized pouring furnace, and comprising:

a stopper that brings a lower end thereof into contact with the outlet so as to block the outlet, and is provided so as to be able to rotate about a central axis of the stopper with no rotation angle limitation and move vertically above the outlet;

a rotation motor that rotates the stopper;

a drip detection device that detects dripping of molten metal from the outlet in a case where the dripping occurs; and a control device that, in a case where a drip detection signal is received from the drip detection device, drives the rotation motor to cause the stopper to perform a predetermined rotation operation.

2. The drip prevention device for a pressurized pouring furnace according to claim 1, wherein the stopper is supported by a support device rotatably and elevatably.

3. The drip prevention device for a pressurized pouring furnace according to claim 2, wherein the stopper includes a spline shaft portion slidable with respect to the support device.

4. The drip prevention device for a pressurized pouring furnace according to claim 1, further comprising a transmission member that transmits a rotational force of the rotation motor to the stopper.

5. The drip prevention device for a pressurized pouring furnace according to claim 4, wherein the transmission member is a metallic drive chain.

6. The drip prevention device for a pressurized pouring furnace according to claim 1, wherein an imaging device for capturing an image of the vicinity of the outlet is used as the drip detection device.

7. The drip prevention device for a pressurized pouring furnace according to claim 1, wherein in a case, after rotating the stopper for a predetermined period of time, dripping is still detected in an amount exceeding a threshold value, the pressurized pouring furnace is fully evacuated.

8. The drip prevention device for a pressurized pouring furnace according to claim 1, further comprising a lifting device for vertically moving the stopper.

* * * * *